US006951245B1

(12) United States Patent
Lehman

(10) Patent No.: US 6,951,245 B1
(45) Date of Patent: Oct. 4, 2005

(54) PLATE-TYPE HEAT EXCHANGER COMPRISING A THICK FIN, AND USE OF SUCH A HEAT EXCHANGER

(75) Inventor: Jean-Yves Lehman, Maisons Alfort (FR)

(73) Assignee: L'Air Liquide, Société Anonyme à Directoire et Conseil de Surveillance pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 10/676,966

(22) Filed: Oct. 1, 2003

(30) Foreign Application Priority Data

Oct. 1, 2002 (FR) ..... 02 12139

(51) Int. Cl.[7] ..... F28F 3/02
(52) U.S. Cl. ..... 165/166; 165/152
(58) Field of Search ..... 165/152, 153, 165/166, DIG. 356, DIG. 359; 62/905; 210/175, 210/188; 96/185

(56) References Cited

U.S. PATENT DOCUMENTS

| | | | | |
|---|---|---|---|---|
| 2,376,749 | A * | 5/1945 | Belaieff | 165/153 |
| 2,566,310 | A * | 9/1951 | Burns et al. | 165/166 |
| 3,079,994 | A * | 3/1963 | Kuehl | 165/166 |
| 3,542,124 | A * | 11/1970 | Manfredo et al. | 165/166 |
| 3,568,461 | A * | 3/1971 | Hoffman | 62/905 |
| 4,049,051 | A * | 9/1977 | Parker | 165/166 |
| 4,253,520 | A * | 3/1981 | Friedericy et al. | 165/166 |
| 4,606,745 | A * | 8/1986 | Fujita | 165/166 |
| 5,438,836 | A * | 8/1995 | Srinivasan et al. | 165/166 |
| 6,347,662 | B1 * | 2/2002 | Davidian et al. | 165/166 |
| 6,745,828 | B1 * | 6/2004 | Lehman | 165/166 |
| 2003/0140654 | A1 * | 7/2003 | Briglia | 62/654 |

FOREIGN PATENT DOCUMENTS

| | | |
|---|---|---|
| EP | 0 203 458 A1 | 12/1986 |
| EP | 0 706 212 A2 | 4/1996 |
| EP | 0 919 780 A2 | 6/1999 |
| EP | 1 026 468 A1 | 8/2000 |
| JP | 8-285486 | 11/1996 |

OTHER PUBLICATIONS

French Search Report to FR 0212139.

* cited by examiner

*Primary Examiner*—Teresa J. Walberg
(74) *Attorney, Agent, or Firm*—Linda K. Russell; Christopher J. Cronin

(57) ABSTRACT

A plate-type heat exchanger containing a number of stacked dividing plates of roughly uniform thickness (e), at least one passage, and at least one fin. The minimum thickness (e') of the fin is 0.8 times greater than the thickness (e) of each dividing plate(s).

9 Claims, 3 Drawing Sheets

PLATE-TYPE HEAT EXCHANGER COMPRISING A THICK FIN, AND USE OF SUCH A HEAT EXCHANGER

This application claims the benefit of priority under 35 U.S.C. § 119 (a) and (b) 1 to French Application No. 0212139, filed Oct. 1, 2002, the entire contents of which are incorporated herein by reference.

BACKGROUND

The present invention relates to a plate-type heat exchanger, particularly to a brazed-plate heat exchanger.

Such heat exchangers are used for example to reheat or vaporize oxygen or oxygen-rich fluid, particularly in air separation plants. An oxygen-rich fluid is defined as one having a number of $O_2$ molecules with respect to the total number of molecules greater than 20% when the fluid is under pressure at least equal to 20 bar, and greater than 50% at lower fluid pressures, particularly greater than 60%.

Such heat exchangers may be used for distilling gas, air or hydrocarbons and more particularly still in a double air distillation column.

The body of a vaporizer-condenser consists of a stack of a great many vertical rectangular plates, all identical. Inserted between these plates are, on the one hand, peripheral sealing bars, and on the other hand corrugated spacers or fins, namely heat exchange corrugations with a vertical main orientation and distribution corrugations with a horizontal main orientation.

Other exchangers for which the invention is intended, are, for example, the main heat exchangers of pump equipment or any other plate-type heat exchanger, which vaporize oxygen under pressure.

In general, the corrugated spacers are obtained from thin sheet, typically of between 0.15 and 0.60 mm thick, bent, cut or stamped in a press or using other suitable tools.

Oxygen vaporizers are a place where fuels heavier than oxygen, such as hydrocarbons, particularly $C_2H_2$ present in small quantities in the atmospheric air like to concentrate. Combustions in the liquid oxygen can occur by accident in such vaporizers. It has been found that these combustions could have the effect of producing at least local explosions. In accidents of this type, it has been found that thin fins, particularly fins made of aluminium, were very vulnerable to combustion whereas the dividing plates were not. It was found that the dividing plates therefore made it possible to prevent the fire from propagating.

Such problems may also manifest themselves in the vaporization circuits of an exchange line.

A main object of the invention is to produce plate-type heat exchangers able to resist possible ignition phenomena, particularly ones intended for use in the treatment of oxygen-rich fluids, in which exchangers the costs of manufacture are not appreciably increased and the performance in terms of pressure drop and exchange of heat is not appreciably lessened.

SUMMARY

To this end, a plate-type heat exchanger according to the invention comprises a number of stacked dividing plates of roughly uniform thickness, between them defining at least one first passage, and at least one fin arranged in this at least one first passage, the minimum thickness of the said fin being greater than 0.8 times the thickness of each of the dividing plates defining the said passage.

According to other features of the invention, taken alone or in any technically feasible combination:

- the ratio of the minimum thickness of the said fin to the thickness of each of the dividing plates defining the said passage is greater than 1, preferably greater than 1.5, more preferably still, greater than 2; and
- the thickness of each of the said dividing plates is between 0.6 mm and 2 mm;
- the plates are flat and rectangular.

The fin may be produced by extrusion or by machining from a thick flat sheet.

By virtue of the invention, the plate-type heat exchanger has appreciably better mechanical strength, allowing the boundaries governing its use under fluid pressure to be pushed back significantly.

The exchanger may further comprise, in at least one second passage, a fin, the minimum thickness of which is less than 0.8 times the thickness of each of the dividing plates defining the said second passage.

The invention is also aimed at a vaporizer-condenser of a double air distillation column, comprising a heat exchanger as described hereinabove, the first passage being a passage for the vaporization of oxygen.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
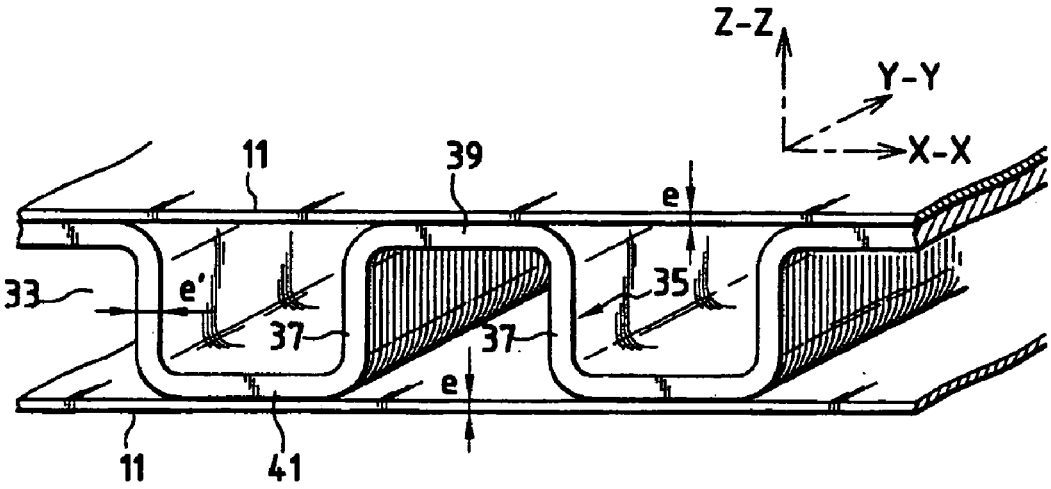
FIG. 1 illustrates a partial perspective view of a plate-type heat exchanger according to the invention, just two dividing plates and one fin arranged in the passage they define between them being depicted.

FIG. 1 depicts two parallel dividing plates 11, of the same thickness e, roughly uniform for one and the same plate, between them defining a fluid passage 33. Arranged in the passage 33 is a fin or corrugation 35 of conventional square-wave overall shape. This fin 35 defines a main general direction of corrugation Y—Y, the corrugations following on from one another in a direction X—X perpendicular to the direction Y—Y.

The directions X—X and Y—Y define the planes of the dividing plates 11, that will be assumed to be horizontal for the convenience of the description, as depicted in FIG. 1. The dividing plates 11 are themselves spaced apart along the vertical axis Z—Z.

The corrugated fin 35 comprises a great many roughly rectangular corrugation legs 37, each contained in a vertical plane perpendicular to the direction X—X. The corrugation legs 37 are connected alternately along their upper edge by roughly rectangular, flat and horizontal corrugation crests 39 and along their lower edge by corrugation troughs 41 which are also roughly rectangular, flat and horizontal.

The corrugation crests 39 and the corrugation troughs 41 define regions for connection by brazing to the flat dividing plates or sheets 11 of the heat exchanger.

As will be understood, the plate-type heat exchanger comprises a number of such dividing plates 11 stacked up and of a thickness e generally roughly constant from one plate to the next. The plates between them define a series of passages 33, a fin 35 being placed in each of the passages 33.

The fin 35 in the fluid passage 33 depicted has a minimum thickness e', the said fin thickness e' being, in the example depicted in FIG. 1, uniform for the entire fin 35.

Typically, the thickness e of the dividing plates is between 0.6 mm and 2 mm.

The minimum thickness e' is chosen to be greater than 0.8 times the thickness e of the dividing plates 11, that is to say, in the case of a thickness e of 1 mm, greater than 0.8 mm.

As a preference, the thickness e' will be given a value such that the ratio of the minimum thickness e' of the fin 35 to the thickness e of the plates 11 is greater than 1, more preferably greater than 1.5, more preferably still, greater than 2.

In the example given in FIG. 1, the fin is essentially produced by bending a thick flat sheet, a sheet being defined as being thick in the art concerned if its thickness is greater than about 1 mm, particularly between 1 and 2 mm.

Figure 2:
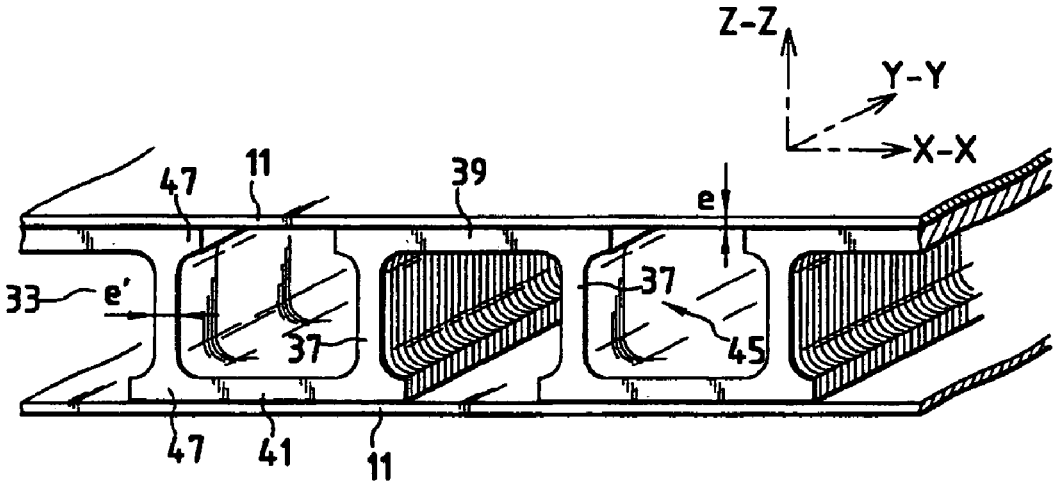
FIG. 2 illustrates a partial perspective view similar to FIG. 1 but according to an alternative form of the embodiment of the invention.
Figure 3:
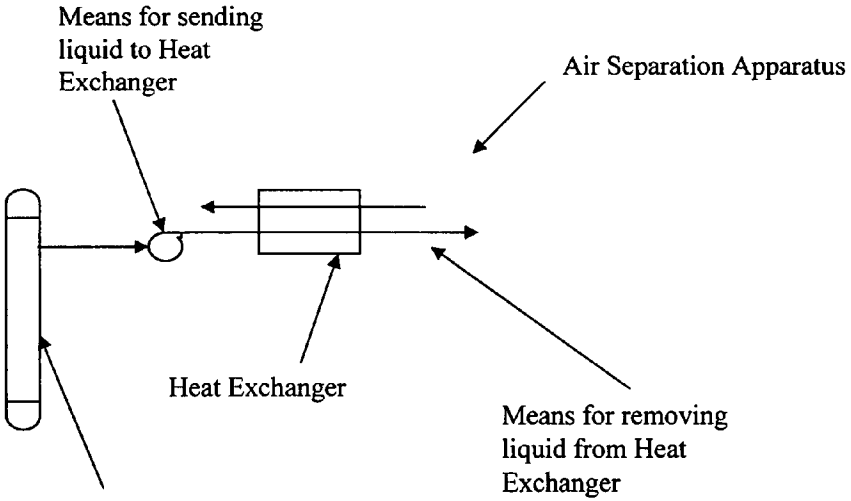
FIG. 3 is a stylized view of a process involving an air separation apparatus with at least one column in accordance with one illustrative embodiment of the present invention.
Figure 4:
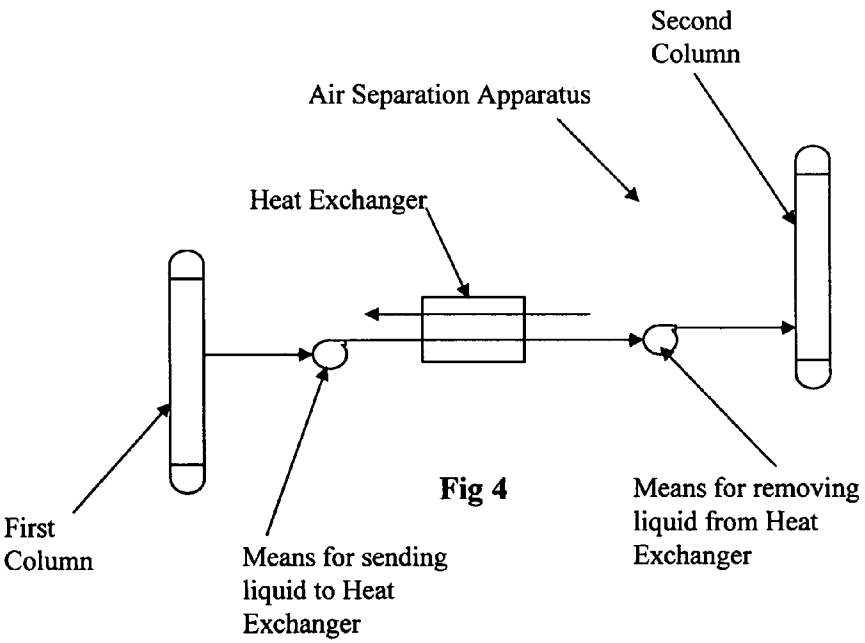
FIG. 4 is a stylized view of a process involving an air separation apparatus with a second column in accordance with one illustrative embodiment of the present invention.
Figure 5:
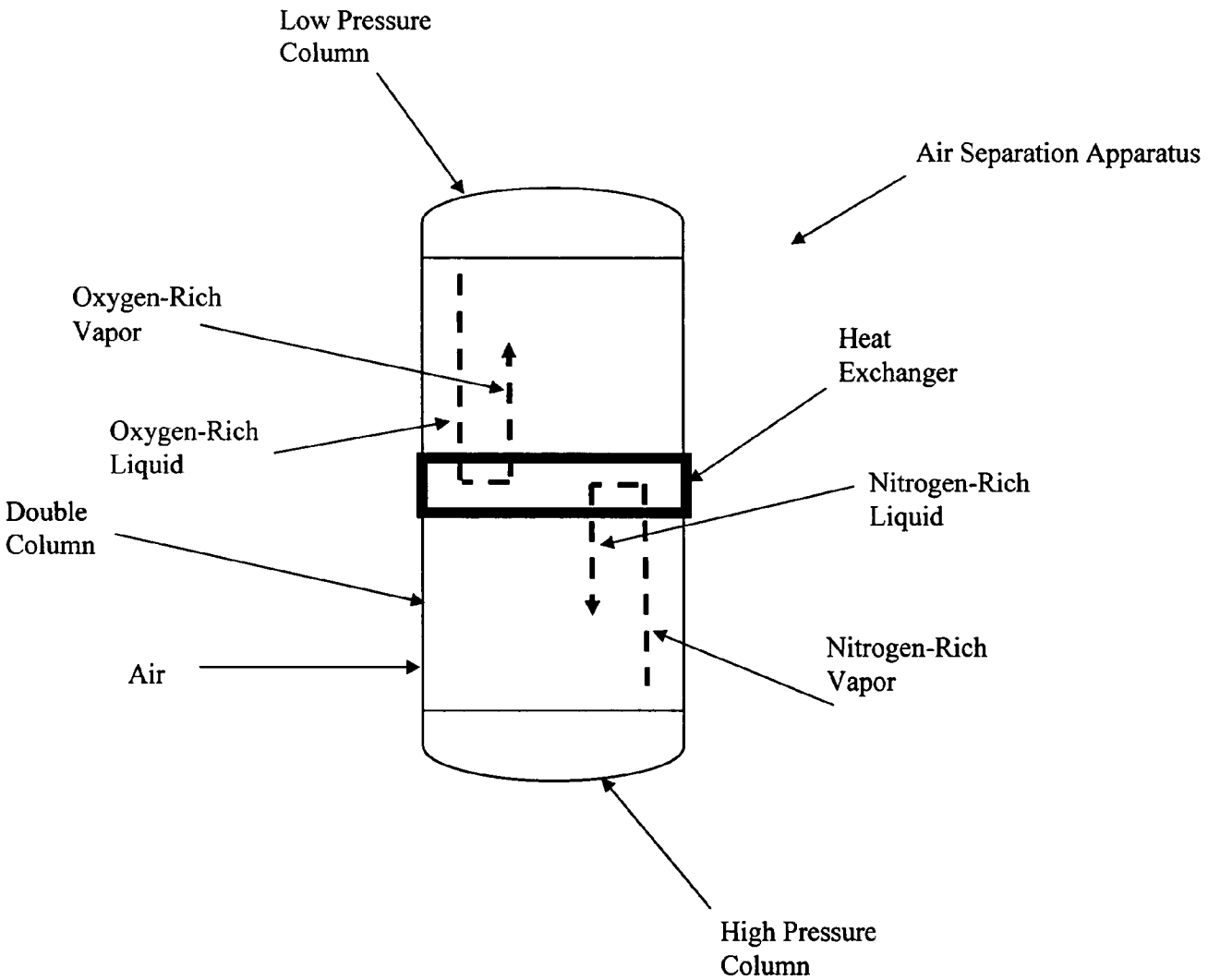
FIG. 5 is a stylized view of a process involving an air separation apparatus with a double column in accordance with one illustrative embodiment of the present invention.

In the exemplary embodiment depicted in FIG. 2, the minimum thickness e' of the fin 45 has a value that meets the conditions set out hereinabove, with reference to FIG. 4. By contrast, the fin 45 is not of constant thickness and has horizontal protruding parts 47 formed on each side of the crests 39 and troughs 41 of the corrugations. These protruding parts 47 make it possible to increase the area of contact between the fin 45 and the plates 1, and therefore the area for brazing, and to improve the mechanical integrity of the fin 45.

Such a fin 45 is essentially produced by extrusion, or by machining from a thick flat sheet.

In the two exemplary embodiments illustrated in the figures, it is possible to anticipate for the exchanger to contain, in part, fins the minimum thickness of which meet the conditions set out hereinabove and, in part, fins the thickness of which is less than 0.8 times the thickness e of the dividing plates 11, the latter fins being produced, for example, from thin sheet using conventional bending methods. As a result, such exchangers can operate with fluids with markedly differing pressures, the thick fins corresponding to fluids at high pressure and the fins made of thin sheet corresponding to fluids at lower pressure.

It will be understood that many additional changes in the details, materials, steps and arrangement of parts, which have been herein described in order to explain the nature of the invention, may be made by those skilled in the art within the principle and scope of the invention as expressed in the appended claims.

What is claimed is:

1. An air separation apparatus comprising:

a) at least one column;

b) at least one heat exchanger which further comprises:

1) at least two stacked dividing plates with a roughly uniform thickness (e);

2) at least one passage between the plates; and 3) at least one fin in a first one of the at least one passage wherein the ratio of the minimum thickness (e') of the each said fin to the thickness of each said dividing plate (e) is greater than about 0.8;

c) means for sending a liquid containing more than 60% mol. oxygen to the heat exchanger; and d) means for removing vaporized liquid containing more than 60% mol. oxygen from the heat exchanger.

2. The apparatus of claim 1 wherein the ratio of the minimum thickness (e') of the each said fin to the thickness of each said dividing plate (e) is greater than about 1.

3. The apparatus of claim 2 wherein the ratio of the minimum thickness (e') of the each said fin to the thickness of each said dividing plate (e) is greater than about 1.5.

4. The apparatus of claim 3 wherein the ratio of the minimum thickness (e') of the each said fin to the thickness of each said dividing plate (e) is greater than about 2.

5. The apparatus of claim 1 wherein the thickness of each of the dividing plates is between 0.6 and 2 mm.

6. The apparatus of claim 1 comprising two columns connected thermally to one another via the exchanger.

7. The apparatus of claim 1 wherein the fins are made of aluminum.

8. The apparatus of claim 1 where the column is a double column.

9. A process for separating air in a plant including a column and at least one heat exchanger which further comprises:

a) at least two stacked dividing plates with a roughly uniform thickness (e);

b) at least one passage between the plates;

c) at least one fin in a first passage wherein the ratio of the minimum thickness (e') of the each said fin to the thickness of each said dividing plate (e) is greater than about 0.8 comprising the steps of separating air in the column, sending a; liquid containing more than 60% mol. oxygen from the column to the heat exchanger and removing vaporized liquid containing more than 60% mol. oxygen from the heat exchanger.

* * * * *